United States Patent [19]

Kleiner

[11] 4,114,761

[45] Sep. 19, 1978

[54] SHOCK ABSORBING DEVICE AND CONTAINER

[75] Inventor: Wayne E. Kleiner, Roanoke Rapids, N.C.

[73] Assignee: W. R. Grace & Co., Duncan, S.C.

[21] Appl. No.: 758,221

[22] Filed: Jan. 10, 1977

Related U.S. Application Data

[63] Continuation of Ser. No. 612,142, Sep. 10, 1975, abandoned.

[51] Int. Cl.[2] ..... B65D 81/16

[52] U.S. Cl. ..... 206/591; 206/45.14

[58] Field of Search ..... 206/587, 588, 589, 590, 206/591, 592, 522, 583, 45.14

[56] References Cited

U.S. PATENT DOCUMENTS

| | | | |
|---|---|---|---|
| 2,596,244 | 5/1952 | Jacket | 206/592 |
| 2,808,189 | 10/1957 | Williams | 206/592 |
| 3,136,413 | 6/1964 | Hall | 206/592 |
| 3,142,599 | 7/1964 | Chavannes | 206/522 |
| 3,192,978 | 7/1965 | Horvath | 206/592 |
| 3,381,873 | 5/1968 | Kashichi | 206/592 |
| 3,487,921 | 1/1970 | Barth et al. | 206/592 |
| 3,527,405 | 9/1970 | Harding | 206/592 |
| 3,669,257 | 6/1972 | Janicke | 206/592 |
| 3,853,221 | 12/1974 | Boyd | 206/592 |
| 3,999,661 | 12/1976 | Jones | 206/591 |

*Primary Examiner*—William Price
*Assistant Examiner*—Joseph Man-Fu Moy
*Attorney, Agent, or Firm*—John J. Toney; William D. Lee, Jr.; John B. Hardaway

[57] ABSTRACT

A resilient flexible wall comprising plastic composition has an inner portion and a second portion connected to and disposed at least partially about the inner portion. The second portion extends radially outwardly relative to the inner portion and includes one or more resilient flexible segments of plastic composition. Also disclosed is a container including the wall as a component thereof. In a preferred embodiment the second portion of the wall extends radially in sinuous configuration, and the wall is prepared by blow molding a preform against a mold surface having a corresponding sinuous configuration.

The wall is useful for supporting articles thereon with improved resistance to article damage resulting from impact forces which may be developed on the wall.

6 Claims, 16 Drawing Figures

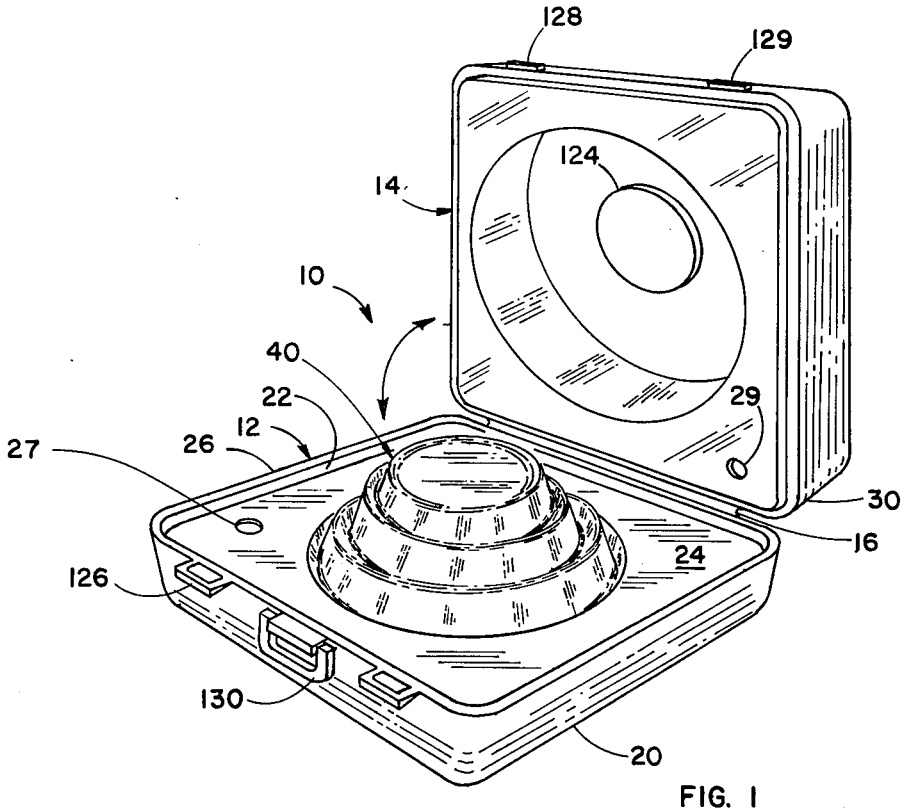
FIG. 1
FIG. 2
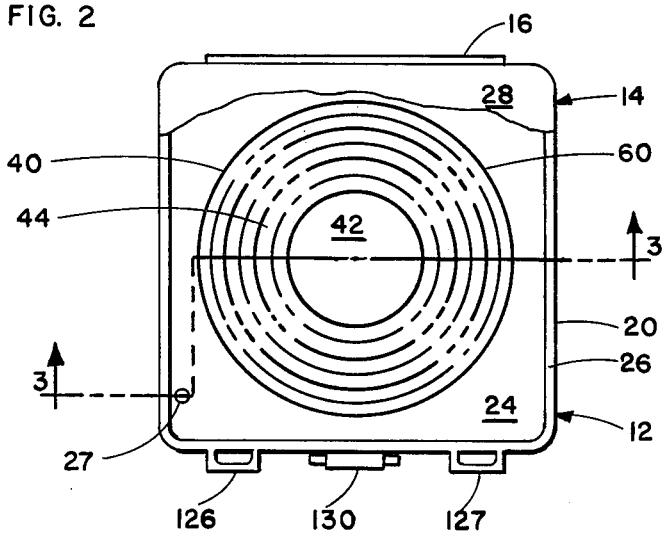

SHOCK ABSORBING DEVICE AND CONTAINER

This is a continuation of application Ser. No. 612,142, filed Sept. 10, 1975 now abandoned.

The present invention relates to a new shock-absorbing device, an improved container including the device as a component thereof, and a package including the container and an article supported on the shock-absorbing component.

Packaging damage-prone articles in containers has long been a problem source in the art. Shock-sensitive articles have presented particularly troublesome problems from the standpoints of packaging and movement and storage of the resulting packages. Numerous attempts have been made to overcome the problems including use of supports or dunnage such as inflatable materials, foam pads and other means. The prior art attempts to recognize and solve the problems have not been entirely satisfactory from the standpoints of cost, time and efficiency.

Containers of hollow, double wall construction are known in the art. Schurman et al., U.S. Pat. No. 3,441,071, discloses a container wherein the hollow, double wall construction provides a protective cushion for the contents of the container.

For a further description of double-wall containers and methods and apparatus for making them, see Schurman U.S. Pat. Nos. 3,317,955; 3,327,841; 3,339,781; and 3,452,125. See also Zeamer, U.S. Pat. No. 3,822,083, which describes a blow-molded double-walled thermoplastic carrying case for a typewriter.

It has now been found that numerous deficiencies of the prior art are overcome in simple, efficient and effective manner by practice of the present invention, which in an aspect provides improvements in containers having one or more parts of hollow, double wall construction by means of a novel shock-absorbing device.

Generally stated, in an aspect of the present invention there is provided a device comprising a generally ring-shaped resilient flexible wall comprising plastic composition. The wall has an inner portion, an outer peripheral portion and an intermediate generally ring-shaped portion extending in sinuous configuration from the inner portion and terminating to the outer peripheral portion. The intermediate portion has at least one resilient flexible segment of the plastic composition.

The present invention also provides a device comprising a resilient flexible wall comprising plastic composition, the wall having an inner portion and a second portion connected to and disposed at least partially about the inner portion. The second portion extends radially outwardly relative to the inner portion and includes one or more resilient flexible segments of plastic composition.

Typically, the device is characterized with eminently effective resistance to shock, that is in use the device absorbs impact forces to an extent such that an article supported thereon is substantially insulated from impact.

Containers of the present invention including the present device as a component thereof exhibit improved cushioning for articles supported on the device, and at the same time exhibit better resistance to impact failure such as may occur in thin regions of the containers, including for example parting lines and hinge areas.

Practice of the present invention will become more apparent by referring to the following detailed description and the accompanying drawing wherein similar elements are identified by like numerals throughout.

In the drawing, briefly stated:

FIG. 1 is a perspective view illustrating a container embodying the present invention and including an embodiment device of the invention as a component thereof;

FIG. 2 is a fragmentary plan view illustrating the container in closed position with part of the cover removed;

Figure 3:
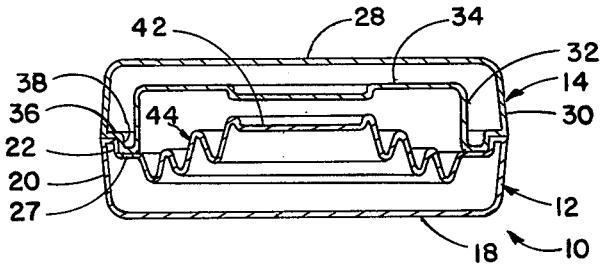
FIG. 3 is a sectional view taken on line 3—3 of FIG. 2, the same as if the cover were not removed.

Referring now in detail to the accompanying drawing, especially FIGS. 1–4, container 10 comprises mating body 12 and cover 14 joined by hinge 16 which preferably is integral therewith. The body is preferably of hollow, double wall construction including a first outer shell having lower wall 18 and side wall 20 projecting therefrom and further including a first inner shell having side wall 22 and upper wall 24 depending therefrom. The side walls of the first and inner outer shells are joined by a peripheral flange illustrated by ledge 26 disposed about the inner shell.

Cover 14 is also illustrated of hollow, double wall construction, having a second outer shell including upper wall 28 and side wall 30 depending therefrom and further including a second inner shell having side wall 32 and a lower wall 34. Side wall 30 is joined to side wall 32 by a second peripheral flange illustrated by inwardly offset ledge 36 inwardly bordered by preferably L-shaped skirt 38, the flange being disposed about the second inner shell.

The body and cover may be of any suitable size, depth and shape. Either the body or the cover may be larger or deeper than the other.

Disposed in and forming part of upper wall 24 of the inner shell of the body is shock-absorbing device 40 which embodies an aspect of the present invention.

Figure 14:
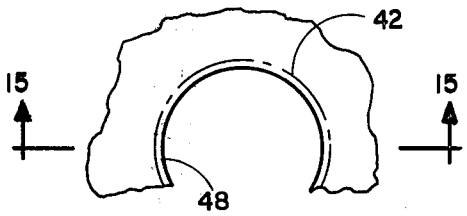
FIG. 14 is a fragmentary partial view illustrating an inner portion of the device in another embodiment.
Figure 15:
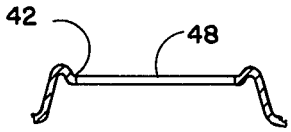
FIG. 15 is a sectional view taken on line 15—15 of FIG. 14.

The device includes a resilient flexible wall comprising plastic composition. In general, the resilient flexible wall has inner portion 42 and second or outer portion 44 connected to and disposed at least partially about the inner portion, the second portion extending radially outwardly relative to the inner portion. The second portion has one or more resilient flexible segments of plastic composition, illustrated by resilient flexible trough 46 shown in radial section in FIG. 5. The inner portion may be of any suitable shape, including generally circular and planar as illustrated in FIGS. 1 to 3. If desired the inner portion may have a hole therethrough defining an inner peripheral portion which may be generally cylindrical and illustrated as cylindrical surface 48, which appears in elevation in FIG. 15 and as an edge in the one half fragmentary plan view of FIG. 14.

In the embodiment shown in FIGS. 1 to 4, the second portion of the device includes first generally frusto-conical wall portion 50 having first minor base 52 and first major base 53, second generally frusto-conical wall portion 54 having second minor base 56 and second major base 57, and a third generally frusto-conical wall portion 58 having a third minor base and a third major base. The first and second generally frusto-conical wall portions are disposed in axially and radially spaced apart manner relative each to the other as indicated radially by the lengths of arrows R-1 and R-2 which extend radially from minor base 52 to minor base 56 and from major base 53 to major base 57, respectively. The axial spacing is indicated by the lengths of arrows A-1 and A-2 which extend axially from minor base 52 to minor base 56 and from major base 53 to major base 57, respectively.

Figure 4:
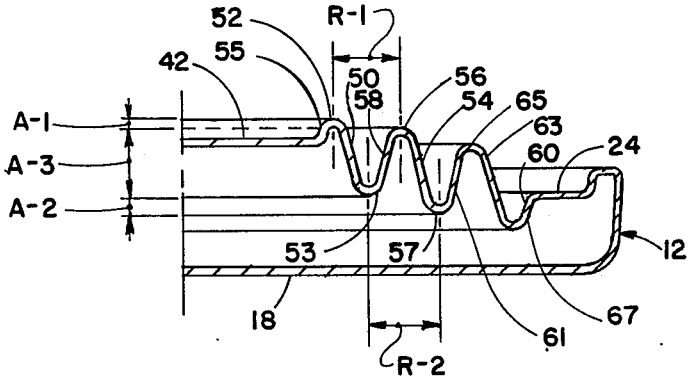
FIG. 4 is an enlargement of part of FIG. 3.

The first and second generally frusto-conical wall portions axially taper or face in a first directional sense, viz. the first and second wall portions taper upwardly from their major bases to their minor bases in FIG. 4. The third generally frusto-conical wall portion 58 is disposed intermediate, and flexibly and resiliently connects, the first and second generally frusto-conical wall portions. The third minor base may be coextensive with the first major base and the third major base may be coextensive with the second minor base, as illustrated. The third generally frusto-conical wall portion axially tapers or faces in a second directional sense which is generally opposite the first directional sense, viz. the third wall portion tapers downwardly from its major base to its minor base.

The first, second, and third generally frusto-conical wall portions thus provide the resilient flexible wall 40 with a generally ring-shaped outer portion which extends in sinuous configuration from the inner wall portion and may extend in sinuous configuration to an outer periphery of the flexible resilient wall. The outer periphery may be substantially at major base 57, at region 60 where, as illustrated in FIGS. 1 and 4, the device 40 joins wall 24 of the container, or at any suitable location along the device between base 57 and periphery 60. As illustrated in FIG. 4, wall 40 may further include another inverted trough defined by fourth and fifth generally frusto-conical wall portions 61 and 63 joined by arcuate region 65 in like manner as described above.

The wall of the device comprises any suitable plastic composition, preferably a plastic polymeric composition, effective for providing resilience and flexibility to the wall. In general, suitable plastic polymeric compositions include homopolymers of monoolefinic monomers having from 2 to about 8 carbon atoms per molecule of the monomer and interpolymers thereof. Polymeric compositions comprising ethylene polymers and propylene polymers are generally suitable. Polymeric compositions including ethylene polymer, e.g. ethylene homopolymer, in an amount from about 51 to 100 percent by weight are highly desirable. Ethylene homopolymer and ethylene-vinyl acetate interpolymer compositions having density from about 0.91 to about 0.965 g/cc (grams per cubic centimeter) and preferably having medium to high density, that is from about 0.926 to about 0.965 g/cc, are eminently suitable. Any suitable amount of vinyl acetate units may be included in ethylene-vinyl acetate interpolymers for use herein. Highly effective ethylene-vinyl acetate interpolymers include vinyl acetate units in amounts up to about 20 or more percent by weight of the interpolymer. Desirably the plastic composition is present substantially throughout the wall, preferably uniformly throughout, for greater flexibility, improved resiliency and better shock absorption.

The plastic polymeric compositions may, if desired, include such additives as antioxidants, accelerators, dyes, inhibitors, activators, fillers, pigments, anti-static agents, flame retardant agents, thickeners, thixotropic agents, surface-active agents, viscosity modifiers, extending oils, plasticizers, tackifiers, and the like. The additives may be present in quantities up to 300 parts or more per 100 parts polymer by weight and preferably from 0.005 to about 100 parts on the same basis.

Figure 6:
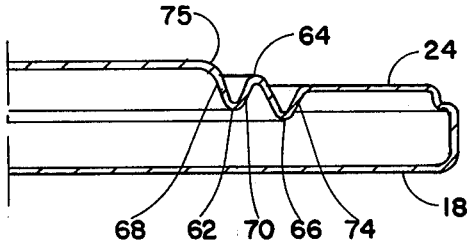

The various generally frusto-conical wall portions desirably have arcuate wall regions interconnecting each to another, as illustrated for example by arcuate regions 62, 64, and 66 in FIG. 6. These regions, which may be of generally curved V-shapes in radial or elevational section as shown, interconnect generally frusto-conical wall portion pairs 68–70, 70–72, and 72–74, respectively. The frusto-conical wall portions also may be arcuate, as shown by the smooth curved surfaces appearing as lines in the sectioned parts of wall portions 68, 70 and 74 (FIG. 6). In general, substantially continuously arcuate outer wall portions of sinuous or undulating configuration are preferred for more uniform resilience and improved shock absorption.

Figure 16:
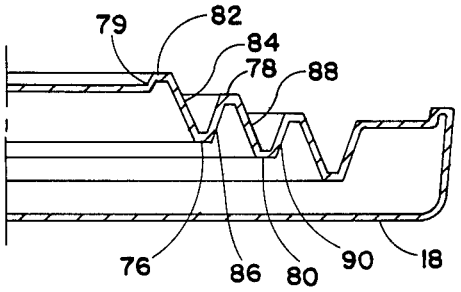
FIG. 16 is a fragmentary sectional view illustrating another embodiment container and device of the invention.

In another embodiment, illustrated in FIG. 16, the shock-absorbing device includes resilient flexible wall 79 having generally planar regions 76, 78, and 80, which interconnect pairs of generally frusto-conical wall portions 84–86, 86–88, and 88–90, respectively. In general, wall 79 is more rigid in the interconnecting regions relative to other resilient walls of this invention having arcuate interconnecting regions.

The resilient flexible wall may be of integral construction. Integral or unitary construction can be provided by blow molding a parison or pre-form of the plastic composition using any suitable mold configuration. Blow molding procedures per se are known in the art. A suitable mold arrangement is shown in part in the section view of FIG. 8 by mold 92 having an undulating or sinuous mold surface portion 94 corresponding generally to sinuous resilient flexible wall portion 96 which is disposed radially outwardly from inner or medial portion 98 of shock absorbing wall 100 illustrated therein. By blow molding, device 100 may conveniently and efficiently be formed of integral construction with container wall 24. In turn wall 24 may be formed integrally with container wall 18 by means of mold 102 which is adapted for mating with mold 92.

Figure 8:
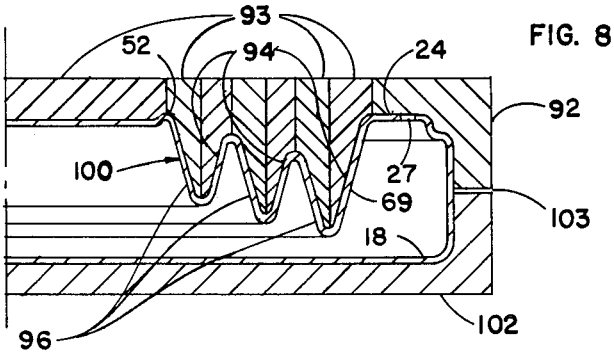

The thickness of the present resilient flexible wall may be generally uniform along its lateral or radial extent. Preferably, the wall is progressively thinner with increasing axial distance such that, for example, the first minor base 52 (FIG. 4 and FIG. 8) has minimum thickness. Walls of this invention having axially progressively thinner wall portions are found upon impact to exhibit preferentially greater resilient deformation in radially inwardly disposed flexible segments with resulting radially inwardly increasing shock-responsive resilient deformation as the shock load or impact increases. Walls of the present device having axially progressively thinner thickness may be conveniently and efficiently formed by blow molding, as illustrated in FIG. 8.

Figure 9:
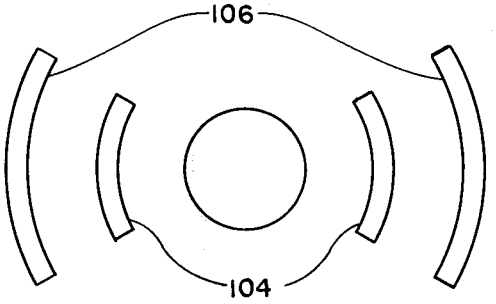
FIG. 9 is a plan view schematically illustrating an embodiment of the present device wherein the outer portion is discontinuous.

The present resilient flexible wall is preferably generally ring-shaped, as shown in FIGS. 1–3. The second or outer portion may be of closed loop construction as shown in FIGS. 1–3 or of open loop construction as illustrated by inner partial ring 104 and outer partial ring 106, which define a sinuous outer wall configuration shown schematically in plan view in FIG. 9. Closed loop constructions are preferred for generally better uniformity of shock dissipation.

Figure 10:
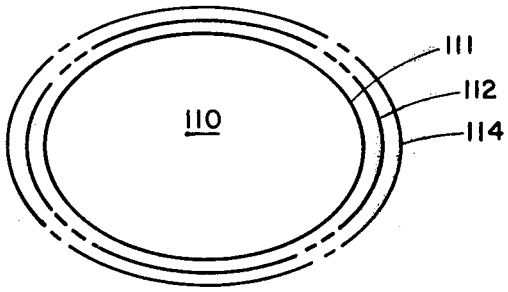
FIGS. 10–11 are plan views schematically illustrating non-circular embodiments of the device.
Figure 11:
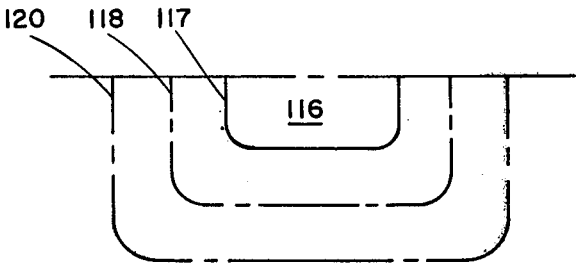

The inner and outer or intermediate portions of the resilient flexible wall may be generally circular in plan view as illustrated in FIG. 2 or of any other suitable shape, for example as illustrated schematically (A) in FIG. 10 by elliptical inner portion 110 having elliptical periphery 111 and elliptical rings 112 and 114 disposed thereabout and (B) in FIG. 11 by generally rectangular inner portion 116 having inner periphery 117 and generally rectangular rings 118 and 120. The broken line rings in FIGS. 2, 10 and 11 schematically illustrate alternating peaks and channels of sinuously configured outer wall portions.

Figure 12:
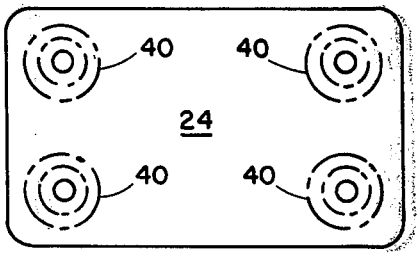
FIG. 12 is a plan view of an embodiment container including plural devices of the present invention.

FIG. 12 illustrates container 122 including wall 24 having a plurality of shock absorbers 40 disposed therein. Container 122 is highly suitable for shock-absorbing support of relatively large articles at a plurality of places on the supported article and for like support of plural articles in one container.

The outer or intermediate wall portion may include any suitable means for its connection to the inner portion. Suitable means include elbow connecting region 75 (FIG. 6) and generally S-shaped region 55 (FIG. 4). In generally like manner, the outer wall portion may include any suitable means for connection with an adjacent outwardly disposed wall, including for example elbow 77 (FIG. 7) and generally S-shaped wall regions 67 (FIG. 4) and 69 (FIG. 8).

The degree of resilience of the wall is dependent on the geometry of the sinuous outer or intermediate wall portion. Resilience may be varied by varying the ratio of trough depth to trough width. For example, higher ratios of R-1: [(A-1 + A-3) + A-3]/2 impart greater resilience to the trough including generally frusto-conical wall portions 50 and 58 and lesser ratios of R-1: [(A-1 + A-3) + A-3]/2 impart lesser resilience to the same trough, wherein R-1, A-1 and A-3 are in the same lineal units, e.g. centimeters. A like ratio with like effect applies for R:A for flexible trough 25 shown in FIG. 5. These ratios may have any suitable magnitude. In general, ratios from about 0.1:10 to about 10:1 are effective, and preferably from about 2:1 to about 1:2.

These ratios and the degree of resilience may be adjusted by use of a variety of adjustable mold inserts which cooperate to present different sinuous mold surfaces. For example, the mold inserts 93 (FIG. 8) can be replaced by other suitable mold inserts or moved axially to provide other mold surface configurations, and thereafter have a parison blown thereagainst to form a variety of shock absorbing devices having broad ranges of resilience and flexibility.

Lower wall 34 of the inner shell of the container cover may be provided with a projection, such as generally cylindrical projection 124, for aid in holding an article supported on shock absorbing device 40 when the cover is closed on the body. The container may include suitable latches 126 and 127 for engaging latch holders 128 and 129, respectively, to secure the cover to the body when the container is closed. Handle 130 may be provided. The container may have one or more holes illustrated by holes 27 and 29 through the inner shells of the body and cover. The holes permit air or other fluid to enter and leave the spaces intermediate the inner and outer shells of the cover and body, thereby aiding in the shock absorption function of the container. The holes may be aligned, as in FIG.13.

Figure 5:
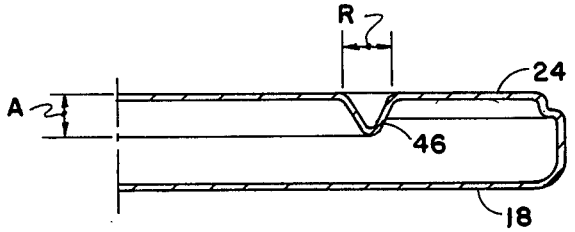
FIGS. 5–8 are fragmentary sectional views illustrating other embodiment containers and devices of the present invention, FIG. 8 further illustrating a versatile blow molding arrangement for preparation thereof.

The present device and container may be prepared by any suitable method, including for example blow molding and vacuum forming thermoplastic composition. In a preferred method of preparing container 10, the body 12 including the device 40 and cover 14 are molded integrally with hinge 16, in one piece, and in a manner imparting great flex endurance to the hinge while providing the hollow, double wall construction of the body and cover. This is accomplished, in accordance with the invention, by blow molding the body and cover and compression molding the hinge in one operation. Conveniently, the container is molded such that the hinge is generally flat and the body and cover are open about 180°, generally as shown in FIG. 5 of Schurman, U.S. Pat. No. 3,441,071, which in pertinent part is incorporated herein by reference.

The molten plastic material is extruded in tubular form between mating mold or die parts, illustrated in part in FIG. 8, which then are brought together to close the plastic tube at opposite ends thereof. Air under pressure is introduced into the closed tube to force it outwardly against the die parts in a manner well known in the blow molding art. The tube is pinched closed not only at end 103 (FIG. 8) and an opposite end, not shown, but also is pinched closed medially of its ends to define and compression mold the hinge 16.

The mating mold or die parts are arranged so that one die part defines the outer shells of the body and cover while the other die part defines the inner shells thereof. The cover and body, the latter including the shock absorbing device, are formed by blow molding wherein compressed air is introduced into the tube or parison moeities corresponding to the body and cover through needle openings 27 and 29, respectively, which are provided at any suitable location. The coacting die parts, in addition to defining spaced cavities for blow molding the container parts, pinch the plastic tube at the hinge and thereby compression mold the hinge.

By blowing a tube of generally uniform diameter and thickness, the region of the tube corresponding to the resilient device being formed is provided with a progressively thinner wall as the distance thereto from lower wall 18 increases, thus effecting eminently suitable flexibility and resilience in the resulting shock-absorbing wall. In this manner there may be provided one or more flexible wall segments each including a turn or wave peak region which is lesser in thickness relative to the average thickness of the wall.

Figure 7:
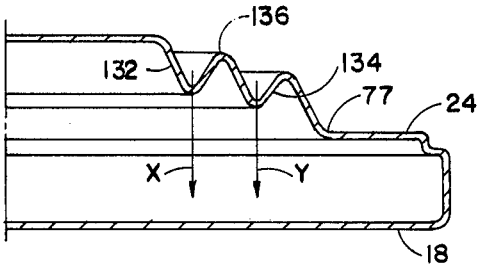

Desirably the device includes at least two flexible segments of plastic composition which project in generally parallel manner one to the other, as illustrated in FIG. 7 by parallel arrows X and Y which schematically bisect trough-shaped flexible segments 132 and 134 and show the direction of projection thereof, respectively. These segments may form a common arcuate interconnection region 136 as shown.

The inner shells of the double wall container may be relatively non-rigid and the outer shells may be relatively rigid, if desired. In general, rigidity increases with increasing shell or wall thickness.

Highly effective containers of this invention include a body having a preferably relatively rigid outer shell, a preferably relatively non-rigid inner shell integrally having the present device disposed therein as next described. The device includes first and second trough-shaped or generally V-shaped resilient flexible segments projecting away from the outer shell and defining a third generally V-shaped segment therebetween which projects toward the outer shell. The first segment is disposed radially inward from the second segment. The apex, illustrated by region 52 (FIG. 4), of the first V-shaped segment is spaced above the point of intersection of a first line defining the shortest line from the apex to the outer shell with a second straight line extending perpendicular to the first line and contacting the apex, illustrated by region 56 (FIG. 4), of the second V-shaped segment.

Figure 13:
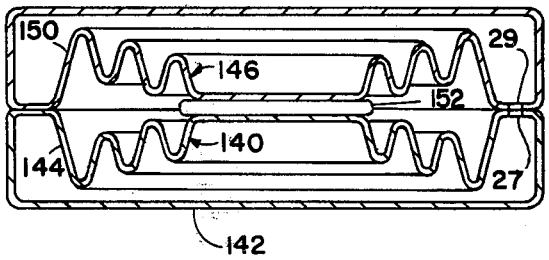
FIG. 13 is a sectional view of an embodiment of the present container including opposing devices of the invention.

In another embodiment, illustrated by the sectional view in FIG. 13, the container is of double wall construction including shock absorbing device 140, embodying this invention, which may be formed integrally with a body having outer shell 142 and inner shell 144, substantially as above described. In like manner, the container further includes a cover having resilient flexible wall or shock absorbing device 146 embodying the present invention, which may be formed integrally with inner shell 150 and outer shell 148. The container may include a hinge formed integrally therewith, not shown, generally as illustrated by container 12 in FIG. 1 and FIG. 2. When an article, illustrated generally by article 152, is placed upon device 140 the cover may be closed onto the body to form a package wherein the two devices cooperate to contact and resiliently hold the article and to substantially minimize damage to the article from shock or impact forces which may be received on the body, cover, or both the body and cover.

When impact is applied to a container including the device of this invention, the device absorbs the impact or shock by resilient deformation, especially in the sinuous areas thereof and minimizes damage to one or more articles supported by the device.

As a general preference, the present shock-absorbing device is generally ring-shaped and of substantially uniform configuration about a central axis thereof.

Polymeric compositions which may be suitably included in the plastic composition include vinyl or olefinic polymer compositions, for example polyvinyl chloride, preferably containing plasticizer in plasticizing amounts. Polymer blends; random, graft, and block interpolymers; and interpolymers of two, three, four or more monomer species may suitably be present in the plastic composition.

In other embodiment containers of this invention, the device is disposed in the surrounding container wall in directionally opposite manner to the manner illustrated in the various drawing figures. For example, the device 40 shown in FIGS. 1 and 3 may be disposed relative to wall 24 as if the device shown therein were inverted 180° about wall 24 such that the illustrated upper surface of the device becomes the lower surface thereof, with the inner portion 42 disposed closer to wall 18.

It is understood that the foregoing detailed description is given merely by way of illustration, and that many variations may be made therein without departing from the spirit or scope of the present invention.

What is claimed is:

1. A container having mating body and cover parts for housing an object therebetween, said parts being joined by a hinge and at least one of said parts being of hollow double wall construction comprising integral inner and outer shells with said inner shell comprising a shock absorbing and retaining means which comprises a wall having an inner article contacting portion and an outer portion connected by at least one resilient flexible intermediate portion, said resilient flexible intermediate portion extending with a generally V-shaped sinusoidal cross section between said inner article contacting portion and said outer portion, said inner article contacting portion being positioned toward the other mating part to a greater extent than said flexible resilient intermediate portion such that said inner article contacting portion is above said intermediate portion when said container is positioned with said shock absorbing and retaining means facing upwardly, whereby said inner article contacting portion is positioned to contact an object in said container when said body part and said cover part are in a mating relationship and to deform said resilient flexible intermediate portion thereby causing said intermediate portion to resiliently urge said inner article contacting portion toward said object, whereby said object is resiliently and immovably housed within said container.

2. The container of claim 1 where said intermediate portion is thinner than said inner or outer portions.

3. The container of claim 1 wherein said intermediate portion is progressively thicker from said inner portion to said outer portion.

4. The container of claim 1 wherein said intermediate portion is a generally ring shaped wall extending in sinuous configuration from said inner portion to said outer portion.

5. The container of claim 1 wherein said cover is of hollow double construction having inner and outer shells with said inner shell comprising a wall having a projection adapted to cooperate with said shock absorbing device so as to protect an article placed on said device when said cover is in a closed position with said body.

6. The container according to claim 1 wherein said body part, said cover part and said hinge are of a unitary integral construction having been produced by blow molding a single parison.

* * * * *